United States Patent [19]

Kreft et al.

[11] Patent Number: 4,795,979

[45] Date of Patent: Jan. 3, 1989

[54] METHOD AND APPARATUS FOR DETERMINING CYLINDER #1 POWER FIRING EVENT IN WASTED SPARK IGNITION SYSTEMS

[75] Inventors: Keith A. Kreft, Arlington Heights; Michael Dikopf, Palatine; Thomas D. Loewe, Wonder Lake, all of Ill.

[73] Assignee: Sun Electric Corporation, Crystal Lake, Ill.

[21] Appl. No.: 941,630

[22] Filed: Dec. 15, 1986

[51] Int. Cl.[4] ..... F02P 17/00

[52] U.S. Cl. ..... 324/379; 123/643

[58] Field of Search ..... 324/379, 380, 391, 392, 324/397; 123/643

[56] References Cited

U.S. PATENT DOCUMENTS 4,396,888 8/1983 Everett et al. ..... 324/379

*Primary Examiner*—J. R. Scott

*Assistant Examiner*—Morris Ginsburg

*Attorney, Agent, or Firm*—Nicholas A. Camasto

[57] ABSTRACT

A method of determining the cylinder #1 power firing event in a wasted spark ignition system comprises developing a first signal comprising the integration of all power firing event signals, a second signal comprises the integration of all wasted firing event signals and comparing the amplitudes of the two signals to determine which represents the power firing events. The firing event signals are sorted for integration based upon knowledge of the polarity of spark plug firings, the cylinder firing order and the occurrence of a #1 cylinder firing event signal.

9 Claims, 3 Drawing Sheets

METHOD AND APPARATUS FOR DETERMINING CYLINDER #1 POWER FIRING EVENT IN WASTED SPARK IGNITION SYSTEMS

CROSS REFERENCE TO RELATED APPLICATION

This application is related to application Ser. No. 686,203, filed 12/26/84, now U.S. Pat. No. 4,644,284, issued 2/17/87 in the names of James G. Friedline and Leo G. Rich, entitled DISTRIBUTORLESS IGNITION SYSTEM INTERFACE FOR ENGINE DIAGNOSTIC TESTERS, and assigned to SUN ELECTRIC CORPORATION and which is incorporated by reference herein.

BACKGROUND OF THE INVENTION

The above-referenced patent describes and claims interface apparatus for enabling conventional automotive diagnostic and test equipment to be used with certain types of direct ignition systems, also referred to as wasted spark or distributorless ignition systems. In a wasted spark ignition system, an individual ignition coil secondary winding is provided for each pair of cylinders, with the ends of the winding being connected to the spark plugs of the respective cylinders. A six cylinder engine, therefore, has six spark plugs and three secondary coil windings. There is no ground voltage reference. When an individual ignition coil secondary winding is "fired," opposite polarity voltages are developed across its ends, and the two spark plugs connected to the winding are fired together. The cylinder pairs are arranged so that one spark plug fires near the end of the compression stroke of its cylinder and its opposite paired spark plug fires near the end of the exhaust stroke of its cylinder. In practice, the wasted spark, that is, the spark produced near the end of the exhaust stroke of its cylinder, has a smaller amplitude than its counterpart power spark because it is not exposed to a gasoline/air mixture that is under compression. The wasted spark actually occurs earlier since the breakdown strength of the exhaust mixture is significantly lower than the breakdown strength of the charged (pressurized) gasoline/air mixture. Since both spark plugs are connected in series through the ignition coil secondary winding, the wasted spark circuit is initially completed through the parasitic capacitances of the system, that is, the capacitances of the spark plug, spark plug wires, etc. Upon occurrence of the power spark a few nanoseconds later, its conductive path includes the parasitic capacitances in addition to the discharge path through the other spark plug.

Most currently available engine tune-up equipment use a dedicated pickup and lead to sense the firing of the #1 cylinder in order to perform engine timing measurements and to synchronize the per cylinder information to specific cylinders in the firing order. In a conventional engine, there is only one cylinder firing event for each complete engine cycle (two engine revolutions in a four-cycle engine). Consequently, there is no confusion when the #1 pickup lead connected to a tester develops a signal. In a wasted spark system, on the other hand, the #1 pickup lead will experience two signals—one for the power firing of the #1 cylinder and another during the power firing of its complementary pair cylinder. On some distributorless ignition systems, there are signals that interface between the Electronic Control Module (ECM) and the distributorless ignition module and which are accessible for detection by engine test equipment to identify the occurrence of a cylinder #1 firing event. As used herein, a #1 signal will mean a signal that identifies a cylinder #1 firing event, irrespective of its origin in the engine. Thus, a tester for such engines must somehow be able to identify the power signal (from the wasted signal) since all of its internal timing and synchronization of data is dependent upon that.

In the disclosed apparatus of the above-referenced patent, the cylinder #1 power firing event signal must, therefore, be differentiated from the cylinder #1 wasted firing event signal so that proper synchronizing information may be applied to the tester. A power firing event is herein defined as that corresponding to the cylinder being spark ignited near the end of its compression stroke (or near the beginning of its power stroke) and a wasted firing event is that which occurs when the cylinder is fired near the end of its exhaust stroke (or near the beginning of its intake stroke). Since the power firing event signals are larger than the wasted firing event signals, they can generally be differentiated based upon amplitude. In the application, the signals are compared with a fixed reference to determine which are the power firing event signals.

There are inherent deficiencies in such a system because the signal amplitudes are dependent upon spark plug condition and the type of vehicle. Also, since the wasted spark path and the power spark path are substantially coextensive and are in series, a problem in either of the two cylinders, or in either of the two spark plugs or in the wiring will affect the signal waveforms captured. Therefore, the amplitudes of the two firing event signals may be insufficient to assure proper engine synchronization under a variety of operating conditions. The present invention solves that problem by "sorting" the two different types of firing event signals from all of the engine cylinders into two separate groups and obtains a weighted average of the relative amplitudes of the groups to determine the group that represents the power firing events and the group that represents the wasted firing events. In this way, one or two abnormally operating cylinders or spark plugs will not significantly affect the outçome of the determination. That information is then used, in conjunction with a cylinder #1 timing signal developed by a clamp-on inductive or capacitive pickup on the #1 spark plug wire (or by any other accessible #1 signal from the engine) and suitable logic, for determining which of the two firing events that occur for cylinder #1 is the power firing event.

OBJECTS OF THE INVENTION

A principal object of the invention is to provide a novel, wasted spark ignition system tester.

Another object of the invention is to provide a reliable method for determining the cylinder #1 power firing event in a wasted spark ignition system.

DESCRIPTION OF THE DRAWINGS

These and other objects and advantages of the invention will be apparent upon reading the following description in conjunction with the drawings in which.

DESCRIPTION OF THE PREFERRED EMBODIMENT

Figure 1:
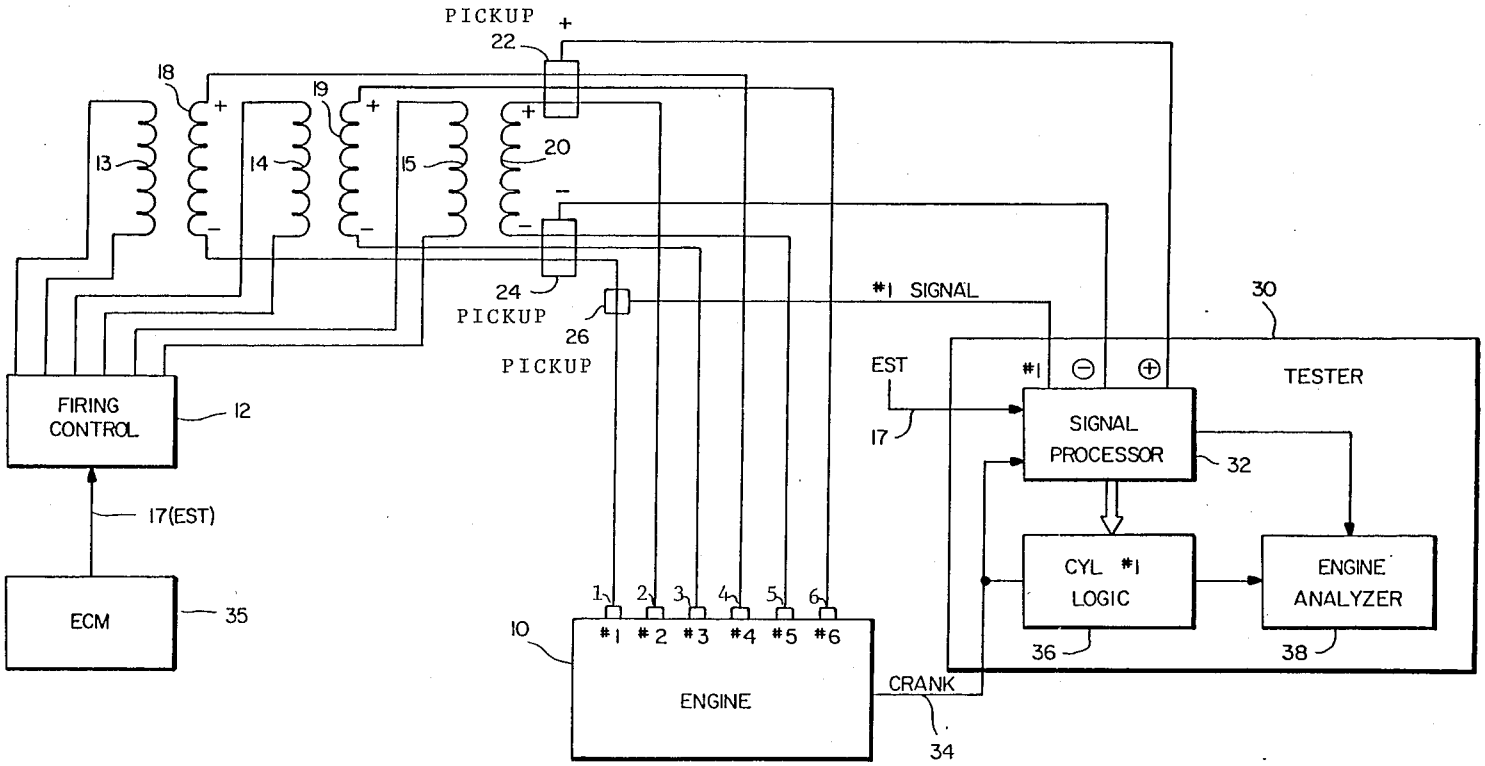
FIG. 1 represents a simplified block diagram of a wasted spark ignition system.

Referring to the drawings, FIG. 1 represents a simplified partial block diagram of an engine and tester for practicing the invention. Engine 10 is shown with six cylinders, (not individually illustrated) arbitrarily labelled #1, #2, #3, #4, #5 and #6 and six corresponding spark plugs 1–6, inclusive.

A block 12 labelled FIRING CONTROL is coupled to a group of three primary ignition windings 13, 14 and 15 which are sequentially energized to cause firing voltages to be developed across three secondary windings 18, 19 and 20, respectively, under control of an Electronic Spark Timing (EST) signal 17 supplied from ECM 35. The EST signal is developed from a crank signal that is produced when the engine rotates and is very similar to it except that one of the EST signal edges is representative of exactly when each cylinder firing is desired, as determined by ECM 35. The crank signal may be conveniently developed by a notched flywheel and sensor arrangement that is well-known in the art. Each of ignition secondary windings 18, 19 and 20 has its respective ends connected to a separate pair of the spark plugs 1–6. Specifically, secondary winding 18 is connected across spark plugs 1 and 4, secondary winding 19 is connected across spark plugs 3 and 6 and secondary winding 20 is connected across spark plugs 2 and 5. Each secondary winding has a plus (+) and a minus (−) end, which may differ depending upon engine design, but will be fixed in any given installation. Thus, each spark plug 1–6 always fires with a given polarity voltage, whether it is a power firing or a wasted firing. In short, the polarities of the firing voltages for the spark plugs are known. For convenience, the wires and spark plugs will be simply referred to as positive or negative polarity, it being understood that the polarity designation refers to the firing voltage appearing thereon. Two capacitive clamp-on pickups 22 and 24 are coupled to the spark plug wires of like polarity to develop suitable positive and negative signals for application to a tester 30. Specifically, positive polarity clamp-on pickup 22 is coupled to the wires connected to spark plugs 2, 4 and 6 and negative polarity clamp-on pickup 24 is coupled to the wires connected to spark plugs 1, 3 and 5. A separate, preferably inductive, clamp-on pickup 26 is coupled to the #1 spark plug wire (or to its complement #4) to develop a #1 signal whenever spark plug #1 is fired. The signals from the pickups 22, 24 and 26 are supplied to a signal processor 32 in tester 30 along with the EST signal 17. Engine 10 also provides a crank signal 34 which, as mentioned, represents a clock pulse derived from the engine flywheel, for example, and which serves as the synchronizing pulse for controlling generation of the EST signal. The crank signal 34 is supplied to signal processor 32 and to a cylinder #1 logic circuit 36. The outputs of logic circuit 36 and signal processor 32 are supplied to an engine analyzer 38 for processing the signals developed, for engine data synchronization, and for displaying waveforms. It will be appreciated that the tester may include other means for performing individual tests or a series of tests on engine 10 as well as apparatus for producing reports and the like, all as well known in the art of automotive diagnostic testing.

Figure 2:
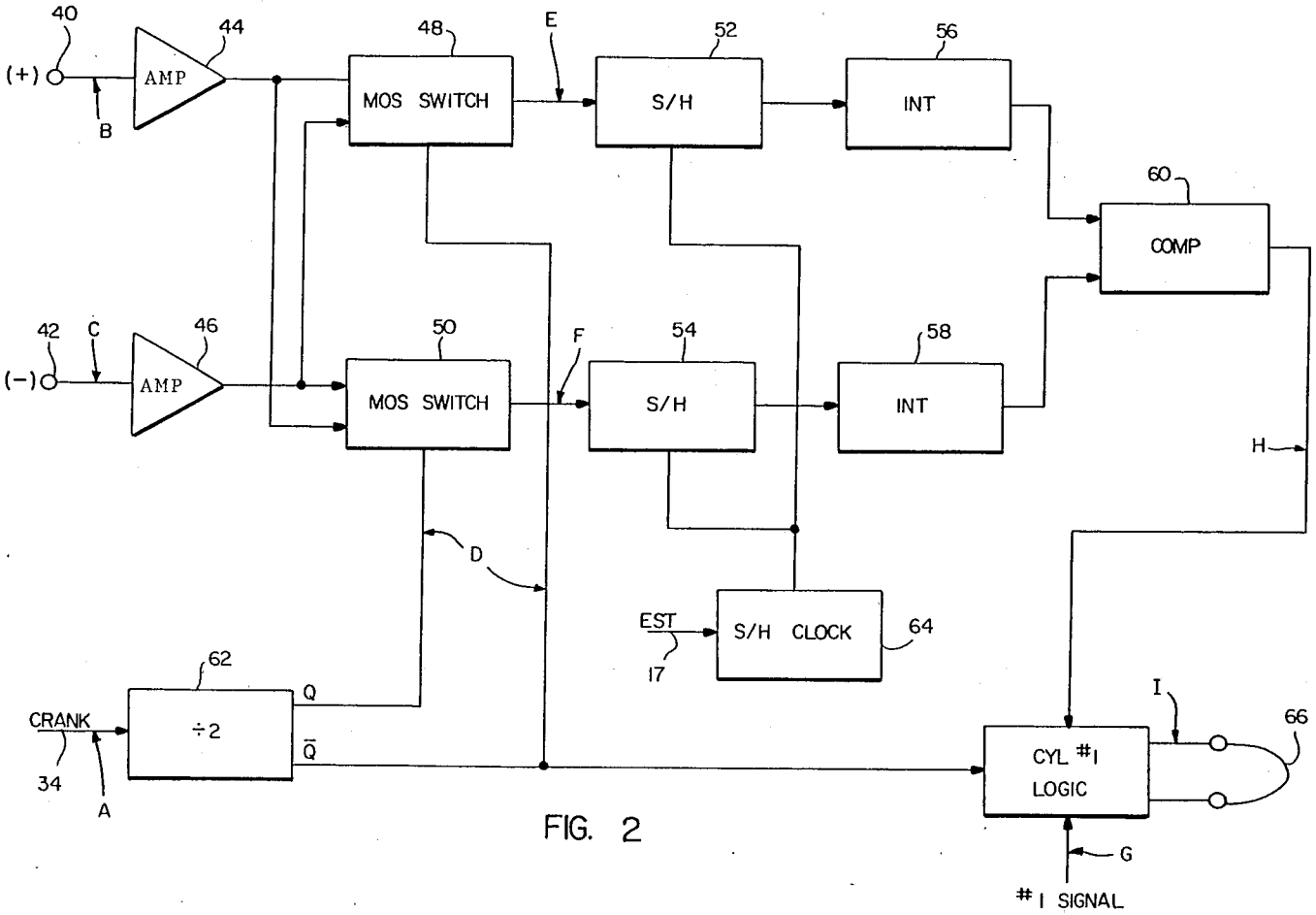
FIG. 2 represents a partial block diagram of the signal processor of FIG. 1.
Figure 3:
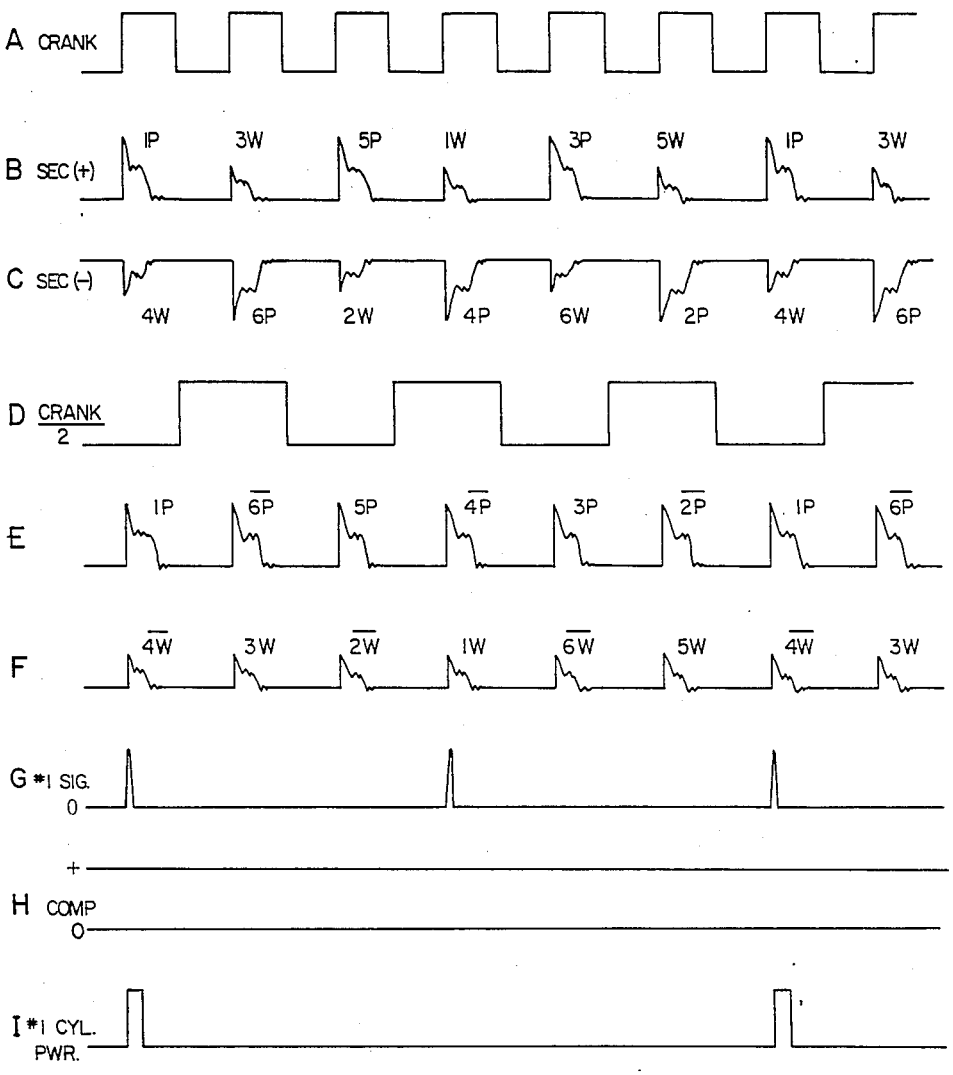
FIG. 3 represents a series of waveforms useful in explaining the invention.

FIGS. 2 and 3 may advantageously be viewed together for understanding the operation of signal processor 32. The letters A–I represent the individual waveforms of FIG. 3 and are indicated at appropriate points about the block circuit diagram of FIG. 2. "A" represents the crank signal which is a square wave pulse train. "B" and "C" represent the positive and negative trains of firing event signals from secondary windings 18, 19 and 20. It will be appreciated that these waveforms are readily available from the outputs of the clamp-on pickups 22 and 24, with "B" appearing on 22 and "C" appearing on 24. As illustrated, the firing order of the engine is 1-6-5-4-3-2, with the negative spark voltages being applied to cylinders 1, 3 and 5 and the positive spark voltages being applied to cylinders 2, 4 and 6. All power event signals represented on "B," "C," "E" and "F" are shown with larger amplitudes than the wasted events and are additionally identified with a "P," while the wasted event signals are identified with a "W." The bar appearing over the cylinder #and firing event type identifier, indicates the cylinder firing event signal has been inverted with respect to its original polarity. For example, $\overline{6W}$ is used to identify the inverted waveform of cylinder #6 firing in its wasted mode.

It should be appreciated, given that as a cylinder is fired in its power mode and the cylinder sharing the same ignition coil secondary winding is fired in its wasted mode at or near the top of its exhaust stroke, each cylinder pair sharing the same ignition coil secondary winding must appear opposite each other in the firing order. Hence, both the polarity and position in the firing order of each cylinder pair sharing the same ignition coil secondary are opposite each other. The series of waveforms of positive polarity is supplied to a terminal 40 connected to the input of a buffer amplifier 44, the output of which is connected to one input each of a pair of MOS switches 48 and 50. The series of waveforms of negative polarity is supplied to a terminal 42 connected to the input of an inverting amplifier 46, the output of which is also connected to each of the other inputs of MOS switches 48 and 50. The crank signal 34 is supplied to a divide-by-two counter 62 having a Q output and a $\overline{Q}$ output, respectively, connected to switches 50 and 48. These signals are indicated as waveform "D" although it will be recognized that the particular polarity of waveform "D" is dependent upon whether the Q or $\overline{Q}$ output is selected. The divide-by-two counter 62 controls the switching of MOS switches 48 and 50 to provide the train of one type of firing events signals (i.e., either power or wasted) at the output of switch 48 and the train of the other type of firing event signals at the output of switch 50. These signals are indentified by waveforms "E" and "F," respectively, and are supplied to sample-and-hold (S/H) circuits 52 and 54, respectively.

In this particular example, the power firing events are shown on waveform "E" and the wasted firing events are shown on waveform "F." The reverse could also have been shown. For the six cylinder engine as described by the plug polarities and firing order shown, the signal trains from pickups 22 and 24 comprise alternating power and wasted firing events. It is, therefore, a simple matter to sort the wasted signals into one group and the power signals into another (although their status is as yet undetermined) based upon their polarity by means of the switching arrangement disclosed. As should be apparent, engines of different configurations may be treated with the same method, it being necessary to know, in addition to a timing signal denoting a cylinder #1 firing event (a #1 signal), the polarities of the spark plugs and the engine firing order. With that information, the wasted and power event signals may be sorted into two groups.

S/H circuits 52 and 54 are both supplied with a signal from S/H clock 64 that is derived from EST signal 17. S/H circuits 52 and 54 operate to hold or sustain the peak amplitudes of the input signals "E" and "F" as each is captured during operation of the S/H clock 64. The outputs of S/H circuits 52 and 54 are respectively supplied to a pair of integrator circuits 56 and 58 where the time weighted average of the amplitudes of the two groups of firing event signals are determined. The outputs of integrators 56 and 58 are supplied to a comparator 60 where an amplitude comparison is made and a suitable polarity output potential is developed as a result thereof. As shown, the comparator output waveform "H" is high when the amplitude of the weighted average of waveform "E" (representing power firing events) is greater than the amplitude of the weighted average of waveform "F" (representing wasted firing events). This signal is applied to cylinder #1 logic block 36 along with the #1 signal "G" and the Q output of the divide-by-two counter 62 to determine which of the cylinder #1 firing event signals ("G") is to be used to generate the "I" signal, representing the cylinder #1 power firing event. In a configuration where the circuit is used as an interface between the engine and an engine analyzer, the output of the #1 logic circuit may be connected as shown to a trigger loop 66. The trigger loop current is sampled by the #1 cylinder clamp pickup (not shown) on the diagnostic tester and is then used for tester synchronization purposes.

As will be apparent to those skilled in the art, the crank signal 34 and the EST signal 17 are used as cylinder clock signals in the preferred embodiment. These signals may be substituted for by similar signals generated from the firing event pulse trains "B" and "C" as is well known in the art of engine test equipment.

To recapitulate, in the six cylinder engine shown, all of the odd-numbered plugs receive positive spark voltages and all of the even-numbered plugs receive negative spark voltages. With the firing order shown, all of the power firing event signals and wasted firing event signals are conveniently "sorted" by switches 48 and 50. For other numbers of cylinders and firing orders, the switches 48 and 50 need to be operated in a sequence determined by the firing order and a knowledge of the "polarity" of the spark plug voltages to assure the correct signals are inverted and that all of the power firing event signals are supplied to one integrator and all of the wasted firing event signals are supplied to the other integrator.

It will be seen that the circuit of the invention determines quite accurately which are the power firing events and which are the wasted firing events. The invention is operable for almost any engine condition, since as long as the engine is running, the power firing events will have a greater average amplitude than the wasted firing events.

It is recognized that numerous changes and modifications in the described embodiment of the invention will be apparent to those skilled in the art without departing from the true spirit and scope. The invention is to be limited only as defined in the claims.

What is claimed is:

1. A method of determining a #1 cylinder power firing event in an engine having a wasted spark ignition system wherein each cylinder is subjected to a power firing event and a wasted firing event and wherein an event of a firing of a #1 cylinder is accompanied by a #1 signal, the firing order of the engine is known and the polarity of each cylinder's spark voltage is known, comprising the steps of:

developing first and second groups of data, representing power firing events and wasted firing events based upon the firing order and polarity of cylinder spark voltages;

comparing said first and said second groups of data to determine which represents the power firing events; and correlating said #1 signal with said power firing events to determine the #1 cylinder power firing event.

2. The method of claim 1 wherein said comparing step determines which of said first and second groups of data represents a greater amplitude.

3. A method of determining a #1 cylinder power firing event in an engine having a wasted spark ignition system wherein each cylinder is subjected to a power firing event and a wasted firing event and wherein an event of a firing of a #1 cylinder is accompanied by a #1 signal, the firing order of the engine is known and the polarity of each cylinder's spark voltage is known, comprising the steps of:

developing a first polarity signal and a second polarity signal based upon the firing order and polarity of cylinder spark voltages, said first signal and said second signal representing power firing events and wasted firing events;

comparing said first and said second polarity signals to determine said power firing events; and correlating said #1 signal with said power firing events to determine the #1 cylinder power firing event.

4. The method of claim 3, further including the steps of subjecting said first and said second polarity signals to sample-and-hold and integrating operations to develop a time-weighted average amplitude for each of said first and said second polarity signals; and comparing said time-weighted average amplitudes.

5. Apparatus in combination with an internal combustion engine of known firing order and having a wasted spark ignition system including a plurality of ignition coil secondary windings for substantially simultaneously subjecting pairs of spark plugs to firing events, a #1 firing event signal indicative of the firing event occurring in a spark plug associatd with a #1 cylinder of the engine, a clock signal indicative of positions of cylinders of the engine, and having positive polarity spark voltages applied to one half of the spark plugs and negative polarity spark voltages applied to the other half of the spark plugs; means for determining a cylinder #1 power spark firing event comprising:

means, including switching means under control of said clock signal, said known firing order and the polarity of the spark voltages, for developing two groups of data from firing event signals from said engine, one group of data representing all power spark firing events and the other group of data representing all wasted spark firing events;

means for discriminating between the amplitudes of said two groups of data for determining which group represents said power spark firing events; and logic means receiving the output of said discriminating means, said clock signal and said #1 cylinder firing event signal for determining the cylinder #1 power spark firing event.

6. The invention of claim 5 wherein said group of data comprise positive and negative polarity firing event signals, respectively.

7. The invention as set forth in claim 6 wherein said discriminating means comprises;

a pair of sample-and-hold circuits supplied with said positive and negative polarity firing event signals;

a pair of integrator circuits supplied with the outputs of said sample-and-hold circuits; and a comparator.

8. The invention as set forth in claim 7 wherein all said firing event signals are developed from clamp-on type pickups associated with said spark plugs.

9. The invention as set forth in claim 8 wherein said engine has six cylinders and wherein said switching means comprise a pair of MOS switches; and said clock signal is a half frequency crank signal.

* * * * *